US007159793B2

(12) United States Patent
Eguchi et al.

(10) Patent No.: US 7,159,793 B2
(45) Date of Patent: Jan. 9, 2007

(54) LIQUID DISCHARGING HEAD AND LIQUID DISCHARGING DEVICE

(75) Inventors: Takeo Eguchi, Kanagawa (JP); Manabu Tomita, Kanagawa (JP); Kazuyasu Takenaka, Tokyo (JP); Iwao Ushinohama, Kanagawa (JP)

(73) Assignee: Sony Corporation, Tokyo (JP)

( * ) Notice: Subject to any disclaimer, the term of this patent is extended or adjusted under 35 U.S.C. 154(b) by 10 days.

(21) Appl. No.: 10/987,258

(22) Filed: Nov. 12, 2004

(65) Prior Publication Data

US 2005/0184169 A1 Aug. 25, 2005

(30) Foreign Application Priority Data

Nov. 13, 2003 (JP) ..... 2003-383232

(51) Int. Cl.
*B05B 1/08* (2006.01)

(52) U.S. Cl. ..... 239/102.2; 239/102.1; 239/556; 239/566; 347/47; 347/54

(58) Field of Classification Search ..... 239/102.1, 239/102.2, 135, 556, 557, 566; 347/44, 47, 347/54, 55, 56
See application file for complete search history.

(56) References Cited

U.S. PATENT DOCUMENTS 6,024,440 A * 2/2000 Murthy et al. ..... 347/65
6,174,049 B1 * 1/2001 Tachihara et al. ..... 347/65
6,409,318 B1 * 6/2002 Clark ..... 347/65
6,472,125 B1 * 10/2002 Koide et al. ..... 430/320
6,682,177 B1 * 1/2004 Hsu et al. ..... 347/63
6,830,317 B1 * 12/2004 Tsuchii et al. ..... 347/56
2002/0063752 A1 5/2002 Clark

FOREIGN PATENT DOCUMENTS

| | | |
|---|---|---|
| EP | 0761448 | 3/1997 |
| EP | 0914948 | 5/1999 |
| JP | 2001-277512 | 10/2001 |

* cited by examiner

*Primary Examiner*—Steven J. Ganey
(74) *Attorney, Agent, or Firm*—Robert J. Depke; Rockey, Depke, Lyons & Kitzinger LLC.

(57) ABSTRACT

A liquid discharging head includes a plurality of liquid discharging units and a common flow path. The liquid discharging units include ink chambers for containing liquid to be discharged, heating elements disposed in the ink chambers for applying discharge force to the liquid, and a nozzle sheet having nozzles for discharging the liquid in the ink chambers. The common flow path supplies the liquid to the liquid discharging units. The liquid discharging units face the same direction in relation to the common flow path, and the nozzles of the liquid discharging units arc disposed at a predetermined pitch. Adjacent nozzles are separated by a predetermined interval in a direction perpendicular to a direction or arrangement of the nozzles.

3 Claims, 15 Drawing Sheets

RECTANGULAR LATTICE ARRANGEMENT

STAGGERED ARRANGEMENT

LIQUID DISCHARGING HEAD AND LIQUID DISCHARGING DEVICE

BACKGROUND OF THE INVENTION

1. Field of the Invention

The present invention relates to a liquid discharging head used as, for example, a printer head of an inkjet printer. More particularly, the present invention relates to a technology for restricting deformation of a nozzle member caused by the discharge of a liquid.

2. Description of the Related Art

A printer head of an inkjet printer is known as a related liquid discharging head of a liquid discharging device. FIG. 11 is an exploded perspective view of a thermal printer head (hereafter simply referred to as "head") 1.

In FIG. 11, heating elements (such as heating resistors) 13 are disposed on the top surface of a semiconductor substrate 15 of the head 1. A barrier layer 16 defining ink chambers 12 is disposed on the semiconductor substrate 15. A nozzle sheet 17 having a plurality of nozzles 18 (that is, through holes that are substantially trapezoidal in cross section along center axial lines) is disposed on the barrier layer 16. The nozzles 18 and the heating elements 13 are disposed so that the center axial lines of the nozzles 18 pass through the centers of the heating elements 13 disposed under the nozzles 18.

The ink chambers 12 are formed by the semiconductor substrate 15 having the heating elements 13 disposed thereon, the barrier layer 16, and the nozzle sheet 17 having the nozzles 18.

In the specification, a portion formed by one ink chamber 12, the heating element 13 disposed in the one ink chamber 12, and the nozzle sheet 17 having the nozzles 18 and disposed above the heating element 13 is called a liquid discharging unit. In other words, the head 1 comprises a plurality of liquid discharging units disposed in parallel. (The same applies to a head 11 of an embodiment described later.)

In FIG. 11, the center of each nozzle 18 is disposed in a straight line in the direction of arrangement of the nozzles 18. Therefore, the center of each heating element 13 is also disposed in a straight line. The nozzles 18 (and the heating elements 13) are disposed in a straight line because, from the viewpoint of a nozzle 18 production technology, they are not particularly difficult to dispose in a straight line. Similarly, the heating elements 13 disposed right below the nozzle sheet 17 are disposed in a line straight line because it is easier to disposed them in a straight line.

A method in which the nozzles 18 are intentionally not disposed in a straight line is also known (refer to U.S. Pat. No. 4,812,859).

FIGS. 12A and 12B are plan views of a row of nozzles 18 and rows of nozzles 18 and dots formed by the row of nozzles 18 and the rows of nozzles 18, respectively. In the figures, the upper side shows the arrangement of the nozzles 18, and the lower side shows the arrangement of the formed dots.

In FIG. 12A, nozzles A1 to A4 and nozzles B1 to B4 are disposed in a straight line as in FIG. 11. In contrast, FIG. 12B, the nozzles A1 to A4 and B1 to B4 are not disposed in a straight line as disclosed in U.S. Pat. No. 4,812,859.

In FIG. 12, four nozzles 18 are defined as one block. The number of nozzles 18 to be defined as one block depends upon, for example, the refill property of ink (that is, the refilling performance for ink lost due to discharge with respect to time), heating, head life, and the degree of liquid surface (meniscus) interference caused by the discharge. Ordinarily, 16, 32, or 64 nozzles are defined as one block. Here, for convenience of explanation, four nozzles 18 are defined as one block.

Ordinarily, when a plurality of nozzles 18 are disposed in one row in a thermal printer head, ink droplets are not discharged from all of the nozzles 18 at the same time or from adjacent nozzles 18 at the same time. The first reason for not carrying out such discharging operations is to eliminate power consumption problems and heating problems arising from the power consumption problems.

The second reason is that, since a common flow path for supplying ink to all of the ink chambers 12 is disposed close to the nozzles 18, when ink droplets are discharged from adjacent nozzles 18 at the same time, interference (crosstalk) is increased, thereby preventing the discharged ink amount from being easily stabilized, and causing considerably variations in the discharge directions of the ink droplets. Therefore, ordinarily, the following method is used. A predetermined number of nozzles 18 is defined as one group, and only one nozzle 18 is allowed to discharge ink in one group at all times. Each group is concurrently operated so that nozzles 18 that discharge ink droplets at the same time are always separated by a distance corresponding to the number of nozzles 18 in each group.

In FIG. 12A, the nozzle A1 of group A (consisting of the nozzles A1 to A4) and the nozzle B1 of group B (consisting of the nozzles B1 to B4) discharge ink droplets at the same time. Therefore, a dot formed by the nozzle A1 and a dot formed by the nozzle B1 are disposed horizontally in a straight line.

After the passage of a predetermined amount of time from the discharge, the nozzle A2 of the group A and the nozzle B2 of the group B discharge ink droplets at the same time. At this time, due to the time difference, a recording medium moves relative to the head during a time equivalent to the time difference, as a result of which dots are formed at slightly displaced locations from the previously formed dots. When a discharge command is subsequently similarly generated, dots are gradually formed downwards and rightwards in FIG. 12A.

In contrast, in FIG. 12B, since the positions of the nozzles 18 are displaced in a direction opposite to the direction of the formation of dots from the beginning by an amount corresponding to the aforementioned time difference, dots are formed in a straight line. In FIG. 12B, the amount of positional displacement caused by the movement of the recording medium relative to the head due to the time difference and the amount of positional displacement of the previously displaced nozzles 18 are set equal to each other.

Accordingly, a method for forming dots in a straight line without disposing the nozzles 18 in a straight line is known.

The nozzle sheet 17 is generally formed of a metallic foil or a thin polymeric material. It is very thin, that is, 10 to 30 μm, when used in, for example, recent high-resolution inkjet printers.

However, when an attempt is made to reduce the thickness of the nozzle sheet 17, the following problems arise.

FIG. 13 is a sectional view of a liquid discharging unit of an inkjet printer when it is designed on the assumption that an ink droplet of 4.5 picoliters is discharged at a nozzle pitch at 600 DPI. FIG. 13 corresponds to a sectional diagram of the head 1 of FIG. 11 along the central axial line of the nozzle 18 at a line connecting the centers of the nozzles 18.

The structure shown in FIG. 13 is formed on the semiconductor substrate 15 by either one of the following known technological methods. They are:

(1) A method for forming a circuit including the heating elements 13 on the semiconductor substrate 15 formed of, for example, silicon by a photomechanical technology, and adding the barrier layer 16 and the nozzle sheet 17 by a separate post-processing step, and (2) A method for forming the structure as well as the nozzle sheet 17 on the semiconductor substrate 15 formed of, for example, silicon by the photomechanical technology.

Method (1) has the advantage that the material and processing method may be selected from a larger number of choices. However, it has the disadvantage that its manufacturing precision is less than that of method (2), which is a combination processing method, because the error in the postprocessing step and the error in the semiconductor processing step (pre-processing step) are generally different.

Although both these methods may be used to form practical liquid discharging units, the discharge performance and production costs of the liquid discharging units differ depending upon the dimensions of each part.

For example, in method (1), when the nozzle sheet 17 is formed by an electroforming process (which is a process which is the reverse of an electrolytic process) using nickel material, the thickness of the nozzle sheet 17 is proportional to, for example, the concentration of the electrolyte and the quantity of electricity. Therefore, the thicker the nozzle sheet 17, the longer the time required to carry out method (1) and the larger the amount of nickel used in the method. Consequently, costs are increased.

The inventor et al. have already proposed a technology for providing high-quality printing by reducing variations in the landing positions of ink droplets as a result of varying the direction of discharge of the ink droplets from the nozzles on the basis of, for example, earlier filed and undisclosed technologies in Japanese Patent Application Nos. 2003-037343, 2002-360408, and 2003-55236. When this technology is used, the thinner the nozzle sheet 17, the larger the amount of deflection of the ink droplets (refer to Japanese Patent Application No. 2003-351550).

In a liquid discharging head typically used in, for example, an inkjet printer, a nozzle sheet 17 having a relatively large thickness value of 20 μm to 30 μm is not rare. However, it may be necessary to achieve required performances using a thin nozzle sheet such as the nozzle sheet 17 shown in FIG. 13 depending upon the purpose of use.

Since the nozzle sheet 17 is always in contact with a liquid (ink), its liquid contact property with respect to the liquid (primarily referring to changes in the physical properties of the surfaces of the nozzles 18 and the melting of the nozzle sheet 17 due to its reaction with the liquid) needs to be considered. Therefore, the composition of the liquid may limit the materials which may be used for the nozzle sheet 17.

Due to the above-described circumstances, since the mechanical strength (Young's modulus, fatigue characteristics with respect to bending, etc.) of materials is limited, methods (1) and (2) give rise to problems in that, when the nozzle sheet 17 is thin, the discharge performance is impaired as a result of changes in pressure applied to the ink chambers 12 when discharging liquid droplets and in that the life is reduced as a result of, for example, repeated fatigue. Therefore, the thickness of the nozzle sheet 17 cannot be made equal to or less than a predetermined thickness value.

In other words, if the nozzle sheet 17 is a rigid body, and pressure is applied thereto by the discharging operation, the amount of deformation of the nozzle sheet 17 can be considered as being so small as to be negligible. Actually, however, the nozzle sheet 17 is deformed because a very high pressure is produced during the discharge.

FIG. 14 shows a photograph of the moment an ink droplet is actually discharged. The nozzle sheet 17 shown in FIG. 14 is formed by electroforming using nickel.

As shown in FIG. 14, the ink droplet is considerably elongated when it is actually discharged. Although the ink droplet is actually discharged downward, it is shown as being discharged upward in FIG. 14. It is observed that areas near the nozzles 18 of the nozzle sheet 17 are flexed when the discharging operation is carried out as shown in FIG. 14. (In FIG. 14, the nozzle sheet 17 is shown as being bulging upward.)

An ordinary discharge of a liquid droplet produces a relatively fine circular dot and satellites (small liquid droplets that fly off by the discharge of the main liquid droplet). As shown in FIG. 14, however, if the liquid droplet is discharged when the nozzle sheet 17 is flexed, a large satellite and a liquid droplet that is not circular are produced. Therefore, dots are often not aligned. FIG. 15 shows in enlarged form a photograph of the arrangement of dots formed when the nozzle sheet 17 is flexed as shown in FIG. 14. In FIG. 15, the pitch between the nozzles 18 (or dots) is represented by P.

As can be understood from the foregoing description, when the nozzle sheet 17 becomes thin, pressure changes during the discharge of liquid droplets cause the areas surrounding the nozzles 18 to flex. Therefore, a stable and a high-quality liquid discharge operation may not be carried out.

SUMMARY OF THE INVENTION

Accordingly, it is an object of the present invention to provide a technology which makes it possible to reduce the thickness of a nozzle member (nozzle layer) while preventing a reduction in liquid droplet discharge performance.

To overcome the aforementioned problems, the present invention provides a liquid discharging head comprising a plurality of liquid discharging units and a common flow path. The liquid discharging units include liquid chambers, discharge force applying means, and a nozzle member. The liquid chambers contain liquid to be discharged. The discharge force applying means are disposed in the liquid chambers for applying discharge force to the liquid in the liquid chambers. The nozzle member has nozzles for discharging the liquid in the liquid chambers by the discharge force applied by the flying discharge force applying means. The common flow path supplies the liquid to the liquid chambers of the liquid discharging units. The liquid discharging units are disposed so that communication portions of the ink chambers with the common flow pat face the same direction in relation to the common flow path. The nozzles of the liquid discharging units are disposed at a predetermined pitch P. The centers of the nozzles of Mth liquid discharging units from one end among the liquid discharging units are disposed on a straight line L1 extending along the common flow path (where M is either an odd number or an even number), and the centers of the nozzles of Nth liquid discharging units from said one end among the liquid discharging units are disposed on a straight line L2 (where N is an ever number when M is an odd number, and is an odd number when M is an even number), the straight line L2 being parallel to the straight line L1 and being separated from the straight line L1 by a predetermined interval X (where X is a real number greater than 0).

In the above-described invention, a plurality of liquid discharging units are disposed so that the portions of the liquid chambers communicating with the common flow path face the same direction in relation to the common flow path, and the nozzles of the liquid discharging units are separated by the predetermined pitch P.

In the direction in which the nozzles are disposed, the centers of the nozzles of, for example, the odd-numbered (first, third, fifth, . . . ) liquid discharging units from one end are disposed on the straight line L1, and the centers of the nozzles of, for example, the even-numbered (second, fourth, sixth, . . . ) liquid discharging units from the one end are disposed on the straight line L2. The straight lines L1 and L2 are separated by the predetermined interval X. Therefore, the distance between the centers of adjacent nozzles is $\sqrt{(P^2+X^2)}$, which is greater than the pitch P.

According to the present invention, the amount of deformation of the areas surrounding the nozzles and the nozzles caused by pressure changes resulting from the discharge of liquid droplets is reduced, so that the amount and direction of discharge of the liquid droplets can be stabilized.

Even if pressure is applied to the surface defining the nozzles when, for example, cleaning the surface defining the nozzles, it is possible to provide a stable contact pressure (that is, to increase the cleaning effect) because a large contact area can be provided at the areas surrounding the nozzles and the deformation of the nozzle member at the areas surrounding the nozzles and of the nozzles is reduced.

DESCRIPTION OF THE PREFERRED EMBODIMENTS

Hereunder, embodiments of the present invention will be described with reference to the drawings.

First, prior to describing the embodiments, deformation of a nozzle sheet 17 that is thin will be described (analyzed).

Figure 1:
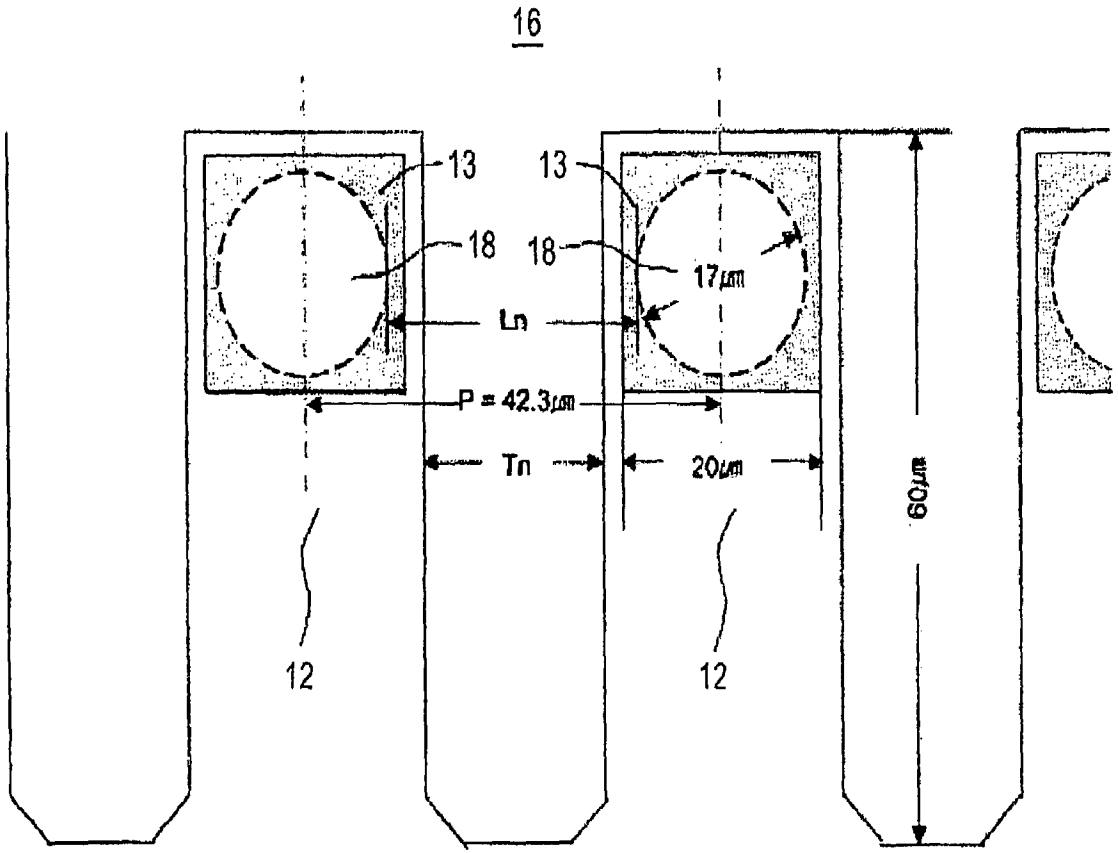
FIG. 1 is a plan view of specific dimensions of a head shown in FIG. 11.
Figure 11:
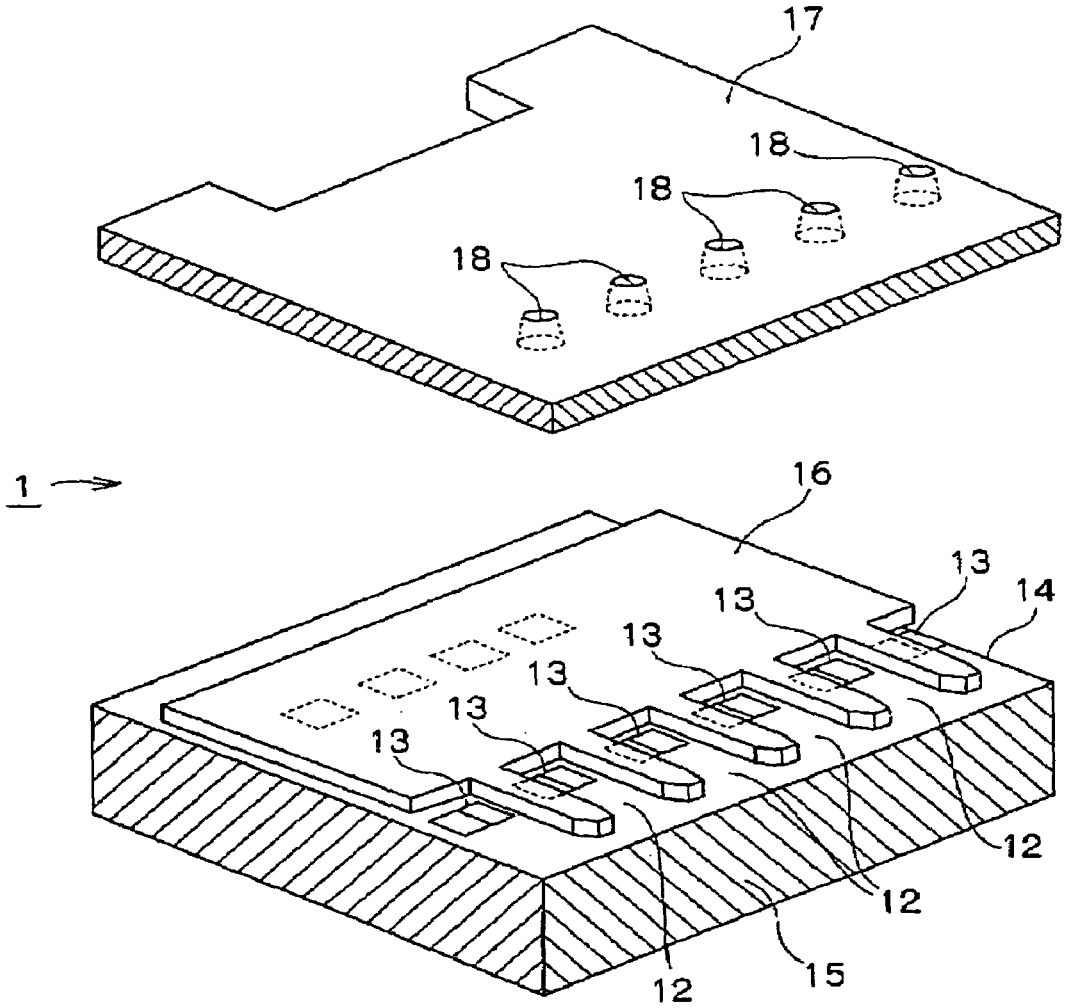
FIG. 11 is an exploded perspective view of the thermal head.
Figure 12:
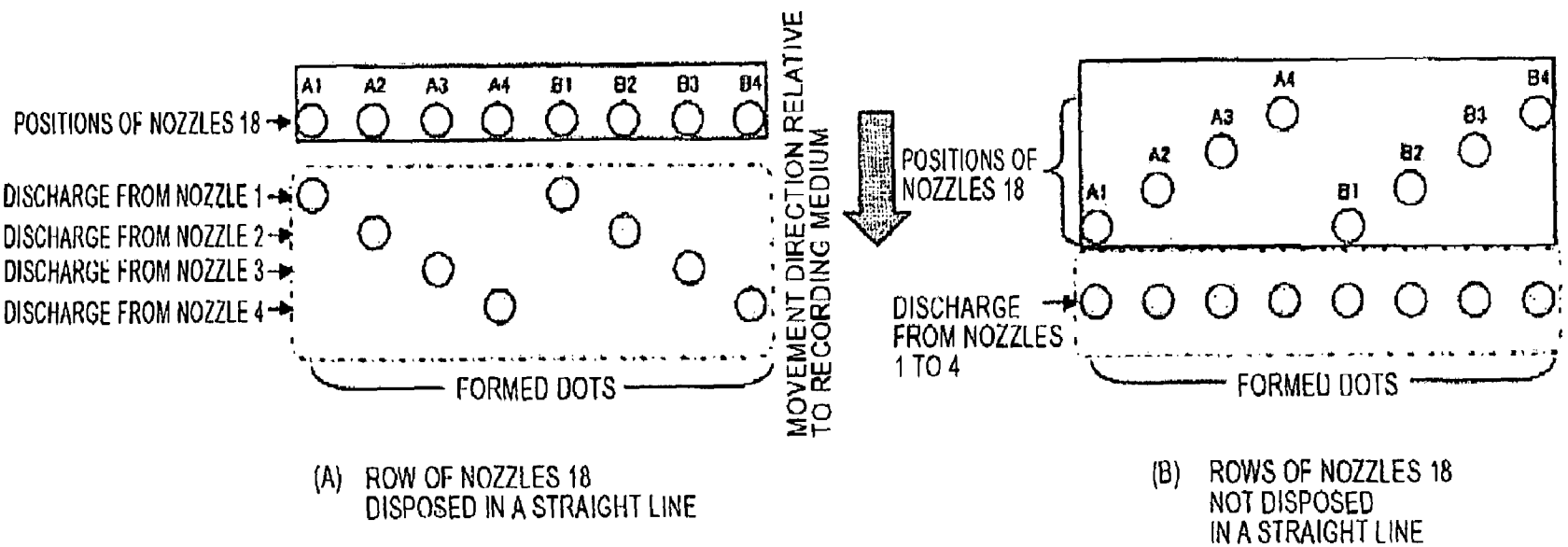
FIGS. 12A and 12B are plan views of a row of the nozzles of the head and dots formed thereby and rows of the nozzles of the head and dots formed thereby, respectively.
Figure 13:
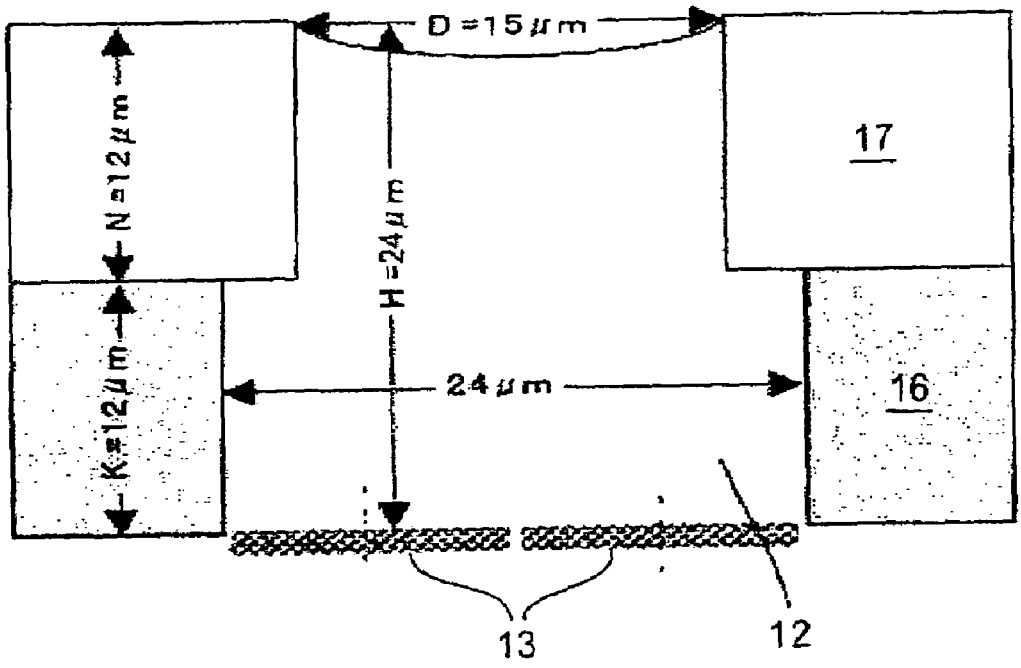
FIG. 13 is a sectional view of a liquid discharging unit when it is designed on the assumption that an ink droplet of 4.5 picoliters is discharged at a nozzle pitch at 600 DPI.

FIG. 1 is a plan view of specific dimensions of the head 1 shown in FIG. 11. A pitch P of each liquid discharging unit (nozzle 18) is 42.3 μm at a physical resolution of 600 DPI. The nozzle diameter at the surface of the nozzle sheet 17 is 17 μm, and the length of one side of each heating element 13 is 20 μm. The overall length of a barrier layer 16 from an end of a side of ink chambers 12 to an end of a side of a common flow path is 60 μm.

A distance Ln between edges of adjacent nozzles 18 is determined by the formula Ln=nozzle pitch P−nozzle diameter. In this case, the distance Ln is equal to 42.3−17, which is only 25.3 μm. Considering variations for preventing contact with the heating element 13 (in this example, 2 μm each are provided at three sides surrounding each heating element 13), a width Tn between adjacent ink chambers 12 at the barrier layer 16 is equal to 42.3−(20+2×2), which is only 18.3 μm.

The barrier layer 16 is formed of a polymeric material, typified by a photosensitive cyclized rubber resist or an exposure hardening dry film resist, because it is required to have adhesiveness with respect to the nozzle sheet 17. Forming the nozzle sheet 17 by, for example, electroforming using nickel produces a large difference between their strengths (primarily Young's moduli). Therefore, when a strong force is exerted upon the surface defining the nozzles 18, the barrier layer 16 is deformed in various ways.

Figure 2:
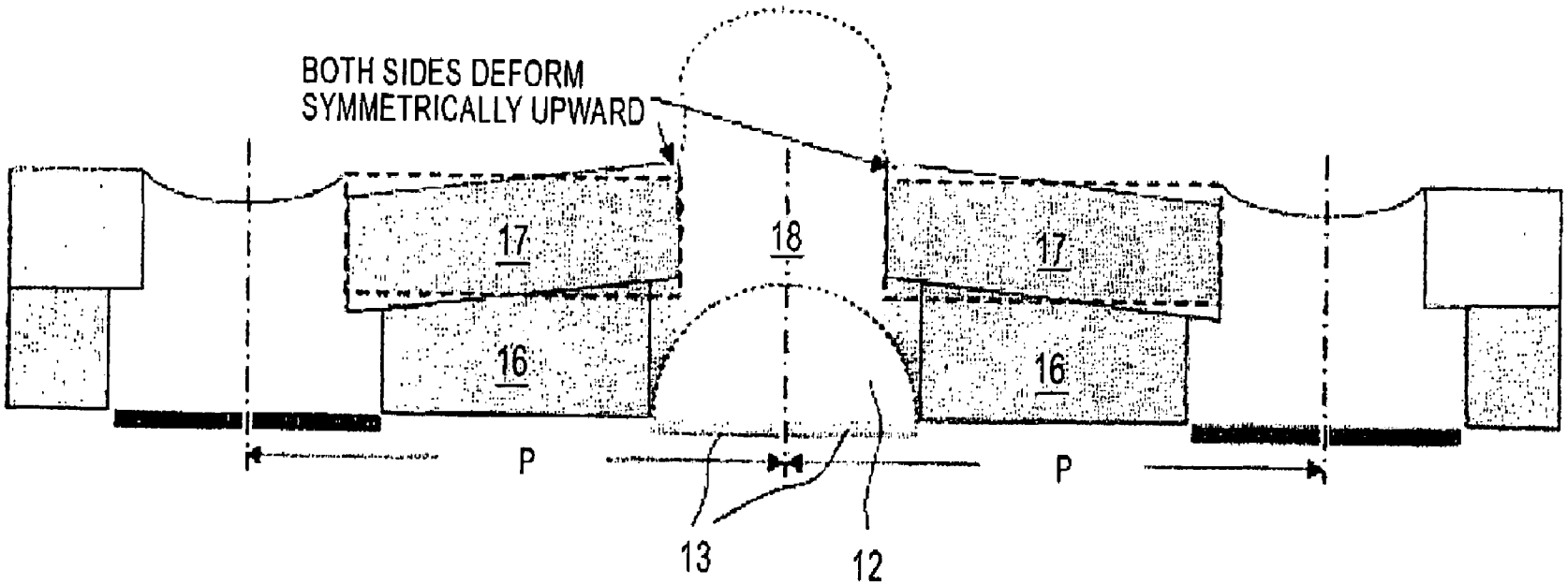
FIG. 2 is a sectional view illustrating the deformation of a nozzle sheet immediately before discharging an ink droplet.
Figure 3:
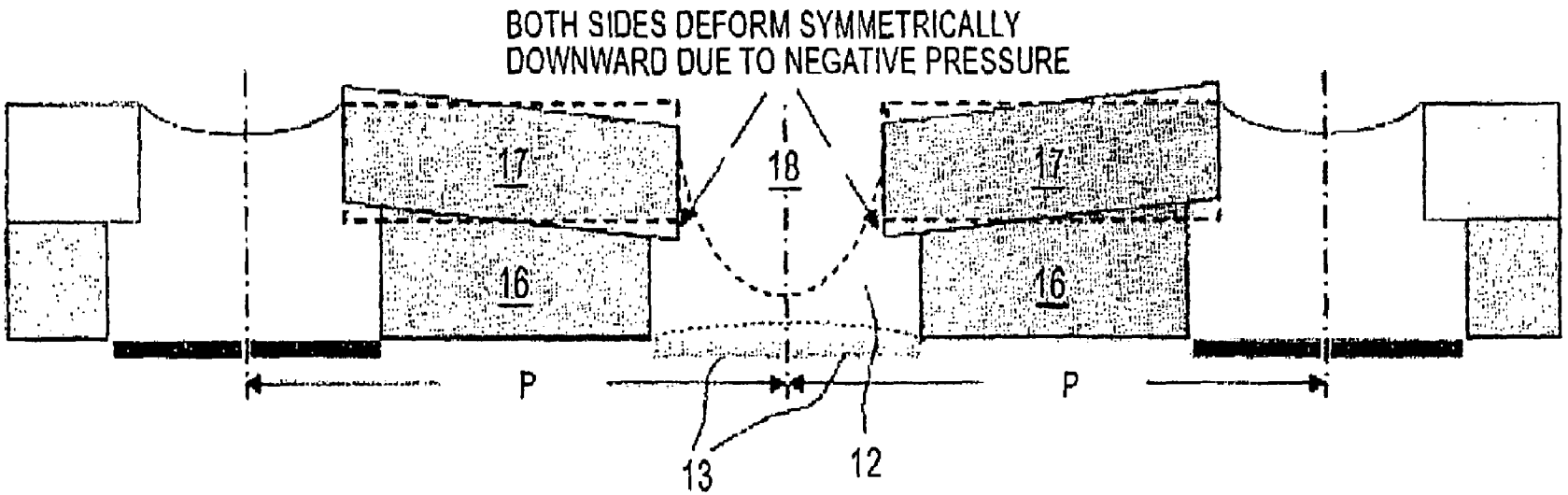
FIG. 3 is sectional view illustrating the deformation of the nozzle sheet when an air bubble is contracting.
Figure 14:
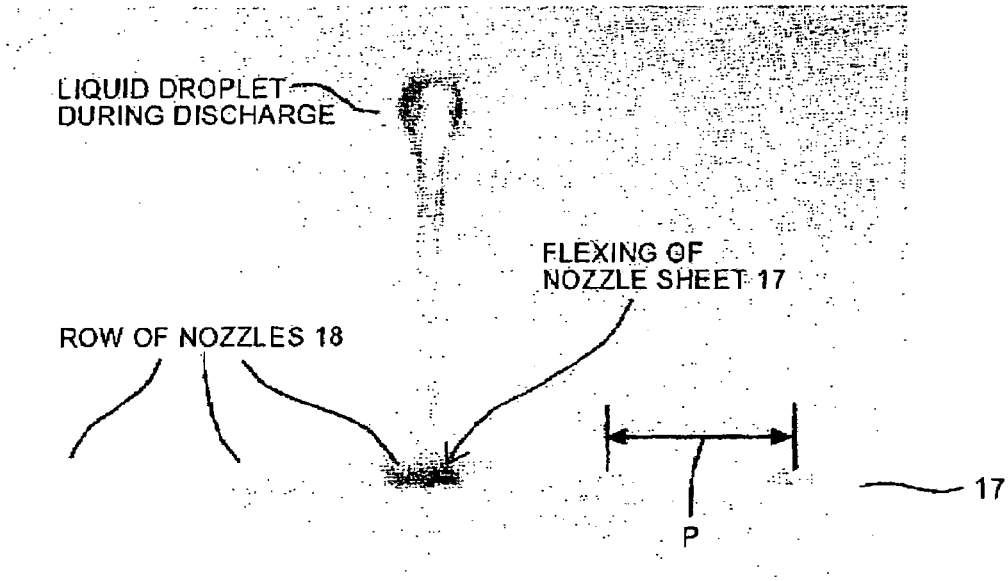
FIG. 14 shows a photograph of the moment an ink droplet is actually discharged.

FIGS. 2 and 3 are sectional views illustrating the deformations of the nozzle sheet 17 and three liquid discharging units disposed in a row. FIG. 2 shows a state in which an air bubble is produced from the heating element 13 in the center ink chamber 12 as a result of applying energy to the heating element 13. This state corresponds to a state immediately before the state shown in FIG. 14 where the liquid droplet is discharged.

FIG. 3 shows a state in which the pressure in the ink chamber 12 suddenly becomes a negative pressure (with respect to the atmosphere) at the time of contraction of the air bubble with respect to the liquid droplet that has flown.

In these states, since pressure variations occur suddenly in the ink chamber 12 (that is, the pressure in the ink chamber 12 suddenly increases and decreases, respectively), the thin barrier layer 16 and nozzle sheet 17 are deformed. In particular, since the nozzle sheet 17 and the barrier layer 16 are less rigid than the semiconductor substrate 15, they are noticeably deformed.

In this case, when the nozzles 18 are disposed in a row in a straight line as shown in FIG. 11 showing the related art, the greatest pressure is applied to the line connecting the centers of adjacent nozzles 18. The distance to the adjacent nozzle 18 is closest on this line. Therefore, as shown in FIGS. 2 and 3, the nozzle sheet 17 tends to move substantially like a seesaw on the barrier layer 16 as the center.

As mentioned above, when the nozzle sheet 17 is thin and the adjacent nozzles 18 are disposed in a straight line, the nozzle sheet 17 and the barrier layer 16 deform when an ink droplet is discharged. This adversely affects the discharge performance (in particular, the dot shapes, that is, the image quality in an inkjet printer).

One method for mitigating the adverse effect on the discharge performance without changing the thickness of the nozzle sheet 17 is to move an adjacent nozzle 18 away from a corresponding nozzle 18, so that the distance between the adjacent nozzles 18 at the barrier layer 16 and in the nozzle sheet 17 disposed on the barrier layer 16 is made as large as possible. This is achieved by either of two methods described below:

(1) The diameter of a nozzle 18 is reduced without changing the arrangement pitch of the nozzle 18 (=42.3 μm at 600 DPI).

(2) The arrangement pitch is reduced without changing the diameter of the nozzle 18.

However, method (1) causes the discharge characteristics to change. In method (1), the smaller the diameter of the nozzle 18, the larger the pressure in the ink chamber 12 when an ink droplet is discharged. However, it is possible to prevent an increase in the pressure by reducing the volume of a generated air bubble by reducing the area of the heating element 13.

Method (2) is effective in that the characteristics of the individual nozzles 18 are preserved. However, the resolution and the performance are reduced.

Accordingly, the present invention provides method (3) in which the liquid discharging units including the nozzles 18 are alternately disposed on two straight lines L1 and L2 that are separated by an interval X without changing the arrangement pitch (42.3 μm at 600 DPI) of the nozzles 18.

Figure 4:
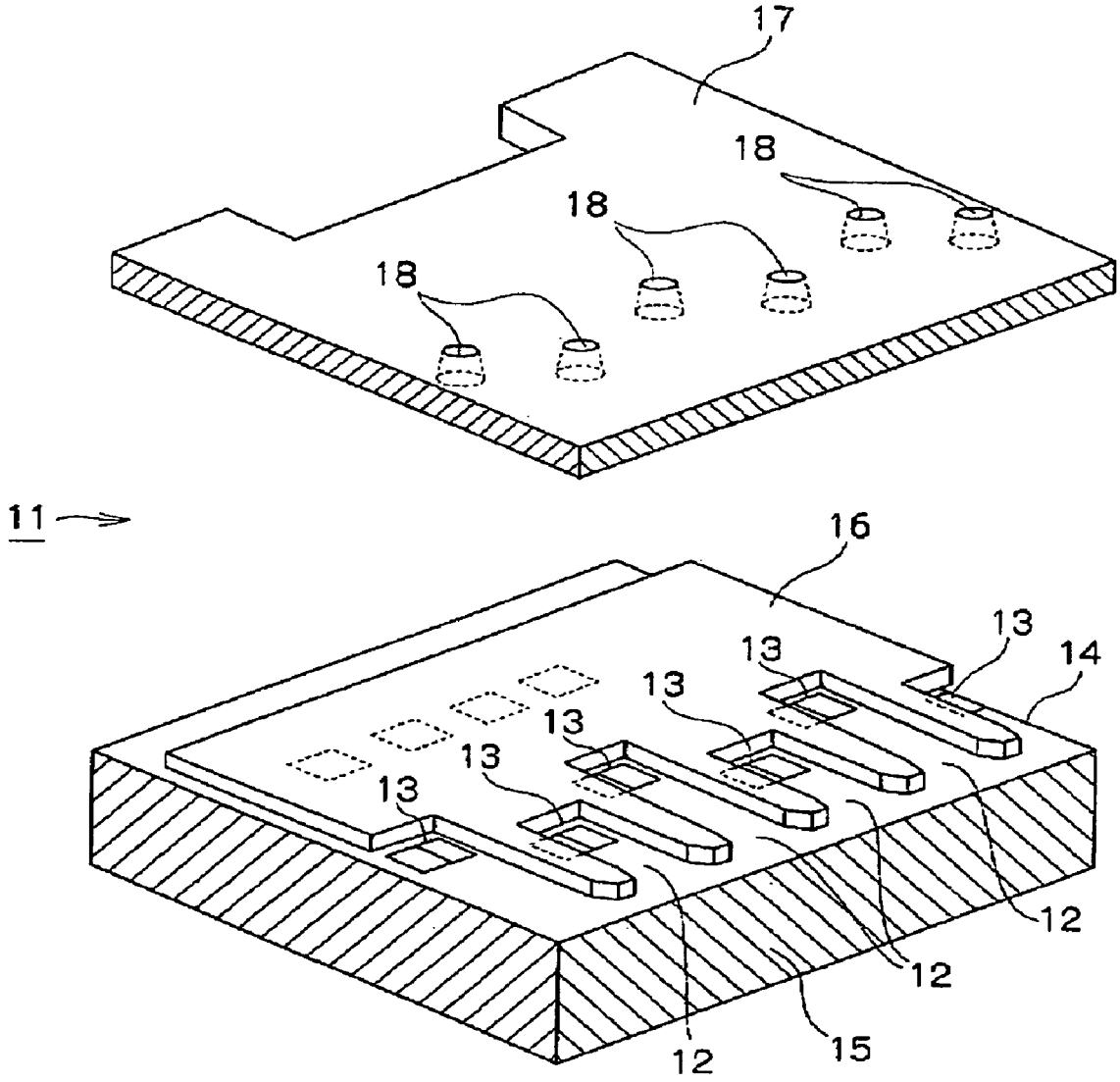
FIG. 4 is an exploded perspective view of a printer head applied to a liquid discharging device of the present invention.

FIG. 4 is an exploded perspective view of a printer head 11 applied to a liquid discharging device of the present invention. FIG. 4 is an exploded view of a nozzle sheet 17 (corresponding to a nozzle member in the present invention) shown separately from a barrier layer 16 although the nozzle sheet 17 is actually affixed to the barrier layer 16.

In the head 11, a substrate member 14 comprises a semiconductor substrate 15, formed of silicon or the like, and heating elements 13 deposited on one surface of the semiconductor substrate 15. In the invention, the heating elements 13 correspond to flying force applying means and, are, in particular, heating resistors in the embodiment. The heating elements 13 are electrically connected to a control circuit (not shown) via a conductor (not shown) formed on the semiconductor substrate 15.

The barrier layer 16 is formed of, for example, an exposure hardening dry film resist, and is formed by photolithography carried out to remove unnecessary portions of the resist placed on the entire surface of the semiconductor substrate 15 where the heating elements 13 are formed.

A plurality of nozzles 18 are formed in the nozzle sheet 17. The nozzle sheet 17 is formed by, for example, electroforming using nickel and is affixed to the barrier layer 16 so that the positions of the nozzles 18 are in correspondence with the positions of the respective heating elements 13 disposed below the nozzles 18, that is, so that the nozzles 18 face the heating elements 13.

Ink chambers 12 are formed by the semiconductor substrate 15 (and the heating elements 13), the barrier layer 16, and the nozzle sheet 17 so that the heating elements 13 are surrounded by the semiconductor substrate 15, the barrier layer 16, and the nozzle sheet 17. More specifically, the semiconductor substrate 15 (and the heating elements 13) form the bottom walls defining the ink chambers 12, the barrier layer 16 forms the side walls of the ink chambers 12, and the nozzle sheet 17 form the top walls of the ink chambers 12.

The head 11 ordinarily comprises units of a hundred heating elements 13 and ink chambers 12 including the heating elements 13. A command from a printer controlling unit causes the heating elements 13 to be uniquely selected in order to discharge ink in the ink chambers 12 corresponding to the selected heating elements 13 from the nozzles 18 facing the ink chambers 12.

In other words, the ink chambers 12 are filled with ink from an ink tank (not shown) connected to the head 11 via a common flow path (not shown) for supplying the ink to the ink chambers 12 of liquid discharging units. By passing pulsed current to the heating elements 13 for a short time, such as 1 to 3 μsec, the heating elements 13 are rapidly heated, causing bubbles to be produced in ink portions contacting the heating elements 13. The bubbles expand in order to push way a predetermined volume of ink (that is, the ink boils). As a result, ink having substantially the same volume as the ink portions that contact the nozzles 18 and that are pushed away is discharged as ink droplets from the nozzles 18 and lands on a recording medium such as a print sheet.

The barrier layer 16 has a substantially comb-teeth form in plan view. Therefore, in FIG. 4, at a location situated rightwards and forwardly from the ink chambers 12, the common flow path extending in the direction of arrangement of the nozzles 18 and the ink chambers 12 communicate with each other.

In other words, all of the liquid discharging units are disposed so that the communication portions of the ink chambers 12 of all of the liquid discharging units with the common flow path face the same direction in relation to the common flow path.

Figure 5A:
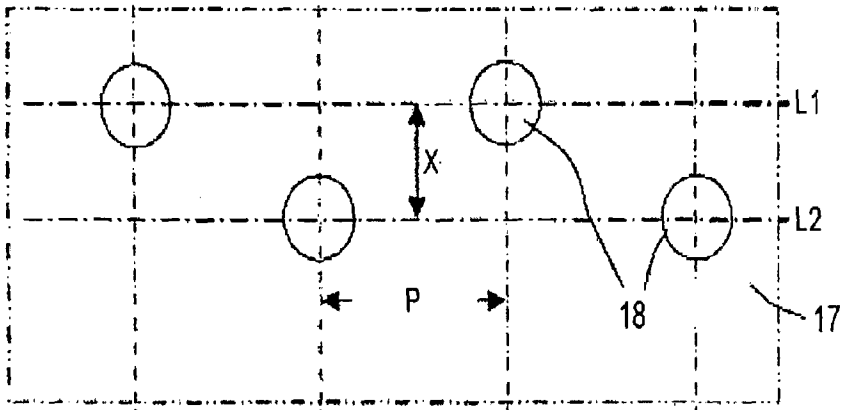
FIGS. 5A and 5B are plan view showing in more detail the arrangement of the nozzles in FIG. 4 and the arrangement of heating elements and ink chambers in FIG. 4, respectively.
Figure 5B:
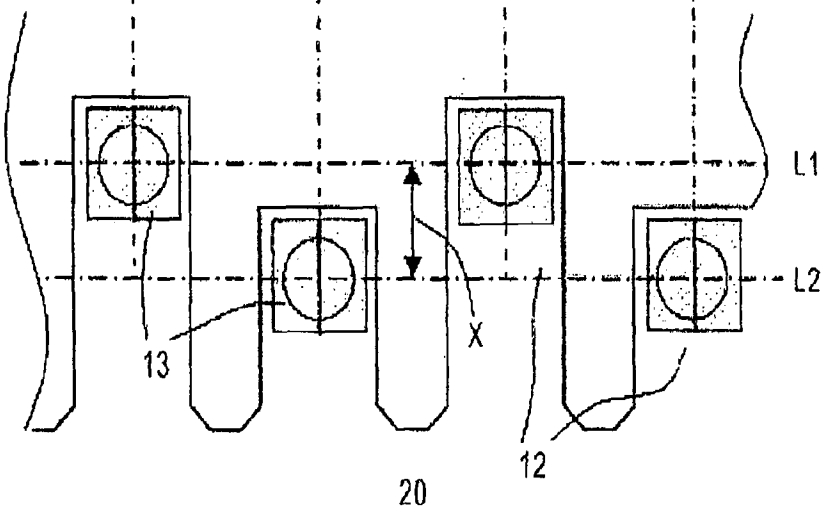

FIGS. 5A and 5B are plan views showing in more detail the arrangement of the nozzles 18 in FIG. 4 and the arrangement of the heating elements 13 and ink chambers 12 in FIG. 4, respectively.

In FIG. 5, the nozzles 18 of the respective liquid discharging units are disposed at a predetermined pitch P.

The centers of the nozzles 18 of Mth liquid discharging units (M is either an odd number or an even number) from one end among the liquid discharging units are disposed on a straight line L1 extending along a common flow path 20, and the centers of the nozzles of Nth liquid discharging units (N is an even number when M is an odd number, and is an odd number when M is an even number) from the one end among the liquid discharging units are disposed on a straight line L2 that is parallel to the straight line L1 and separated from the straight line L1 by an interval X, where X is a real number greater than 0.

Particularly in the example shown in FIG. 5, the centers of the nozzles 18 of the odd-numbered (first, third, . . . ) liquid discharging units from the left side are disposed on the straight line L1, and the centers of the nozzles 18 of the even-numbered (second, fourth, . . . ) liquid discharging units from the left side are disposed on the straight line L2.

The relationships between the interval X between the straight lines L1 and L2 and the arrangement pitch P of the nozzles 18 are as follows.

$$X<P \quad 1)$$

Since ink droplets are not discharged from the nozzles 18 of all of the liquid discharging units at the same time, and, in general, the head 11 and a recording medium move relative to each other continuously when, for example, an inkjet printer is used, dots formed on the recording medium as a result of discharging ink droplets from the nozzles 18 of all of the liquid discharging units are not disposed in a straight line.

As shown in FIG. 5, if the nozzles 18 are disposed on the two straight lines L1 and L2 that are separated by the interval X, the displacement by the interval X as well as the difference between the times of discharge of ink droplets from two adjacent liquid discharging units is added to the positional displacement between the dots formed from the nozzles 18 of the adjacent liquid discharging units (that is, to the positional displacement in a dimension of relative movement between the head 11 and the recording medium). However, if the liquid discharging device is used for, for example, photographic printing by an inkjet printer, making the positional displacement between the dots to that when X<P makes it possible to provide a pleasant image without carrying out a special signal processing operation. (Refer to the experimental results given later.)

In this case, wobbling may be performed in a direction perpendicular to the direction of arrangement of the nozzles 18 from the viewpoint of image processing. Wobbling refers an operation for making it difficult to see a scanning line structure by minutely moving a scanning line vertically in, for example, television scanning.

$$X \geqq P \quad 2)$$

In the formula, the equality sign does not have any strict meaning. The equality sign means that the interval X is large with respect to the nozzle pitch P.

If a signal used for the liquid discharging units disposed in a straight line is used as it is when the positional displacement between adjacent dots becomes equal to or greater than the nozzle pitch P, the time difference corresponding to the interval X (obtained by dividing the interval X by the speed of movement between the head 11 and a recording medium relative to each other) causes a reduction in image quality due to a reduction in resolution. This is because the dots that actually need to be recorded without being displaced in terms of time are displaced by the interval X. This problem can be overcome by providing a signal that previously includes the time difference corresponding to the interval X.

Accordingly, the difference between conditions 1) and 2) is that, in order to provide the same image quality, electrical signal processing operations need to be slightly different due to the difference between the distances of the dots to be formed. However, conditions 1) and 2) are effective in achieving the object of the present invention which is to provide a structure that makes it difficult for liquid discharging units to become deformed by pressure changes caused by the discharge of liquid droplets, although there is a difference in the degree of achievement.

Although, as described above, any relationship between the interval X and the nozzle pitch P is effective, the relationship X=P/2 among these relationships is particularly suitable when evenness is required as in a photographic image. The reason is given with reference to FIG. 6.

Figure 6A:
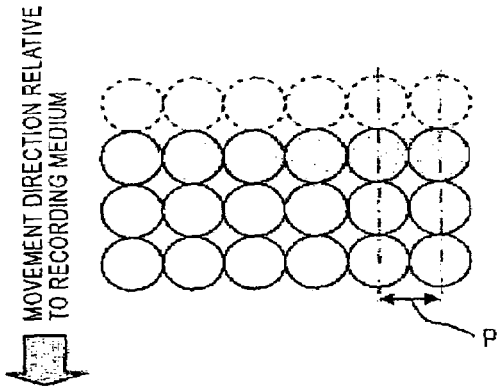
FIG. 6A shows a state in which dots are disposed in a rectangular lattice.

FIG. 6A shows the arrangement of dots when the dot size, the nozzle pitch P, and the relative speed of movement between the head and a recording medium are set so that the formed dots contact each other and are arranged in a rectangular lattice when X=0 (as in the structure shown in FIG. 11) by successively discharging ink droplets from all of the nozzles 18. By this, the distance between the centers of the dots is equal to the nozzle pitch P in both the horizontal and vertical directions. In FIG. 6A, the direction of arrangement of the nozzles 18 and the direction of movement relative to the recording medium are indicated by arrows. In addition, FIG. 6A shows a state in which recording is performed on a third line from the bottom.

Unlike what is mentioned above, the portions of a whole line are actually not recorded at the same time. Ink droplets are successively discharged from groups of a predetermined number of liquid discharging units and there is a time difference caused by the order of discharge of ink droplets within each group. Therefore, strictly speaking, the dots are not disposed in a straight line.

Figure 6B:
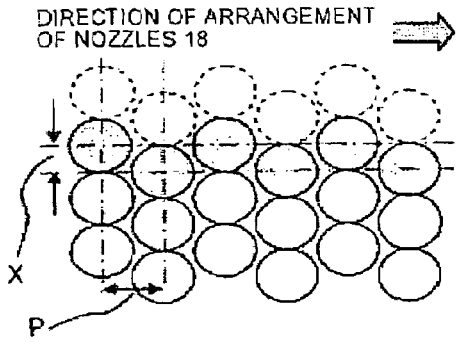
FIG. 6B shows a state in which dots are formed with the head having nozzles whose centers are disposed on lines L1 and L2 separated by an interval X.

FIG. 6B shows an example in which dots disposed by the head 11 having nozzles 18 whose centers are disposed on the straight lines L1 and L2 that are separated by the interval X, with X being equal to P/2. The dot size and the nozzle pitch P are the same as those in FIG. 6A.

In FIG. 6B, the dots are disposed in a staggered arrangement in the direction in which the nozzles 18 are disposed, with the centers of the dots being separated by the interval X in the vertical direction. When the dots are disposed in this way, the dot interval in FIG. 6A and that in FIG. 6B are the same when the dots are viewed vertically (that is, the dimension in which the head 11 (or head 1) and the recording medium move relative to each other). However, when these dots arc viewed horizontally (that is, the direction in which the nozzles 18 are disposed), the dots are disposed without any gap therebetween at the same nozzle pitch P in the horizontal as in the vertical direction in FIG. 6A, whereas in FIG. 6B adjacent dots having the same diameter as those shown in FIG. 6A no longer contact each other because the dot centers are displaced by an amount equal to X=P/2. In other words, even if a dot positional error is considered, adjacent dots are less likely to contact each other. Therefore, although the dot density (that is, the number of dots per unit area) is high, it is possible to increase evenness at an area (having intermediate density) where there is less contact between adjacent dots.

When, for example, an inkjet printer is used, in principle, in the dimension in which the head 11 and the recording medium move relative to each other (that is, a main scanning dimension), the same environment is constantly preserved (that is, if the structure is determined, it is possible to form dots by discharging ink droplets in the same direction from the same nozzle 18 any number of times by an electrical signal). In contrast, in the direction in which the nozzles 18 are disposed, since the dot rows are formed by ink droplets that are discharged from different nozzles 18, the dot pitch is not constant as it is in the main scanning dimension.

Figure 15:
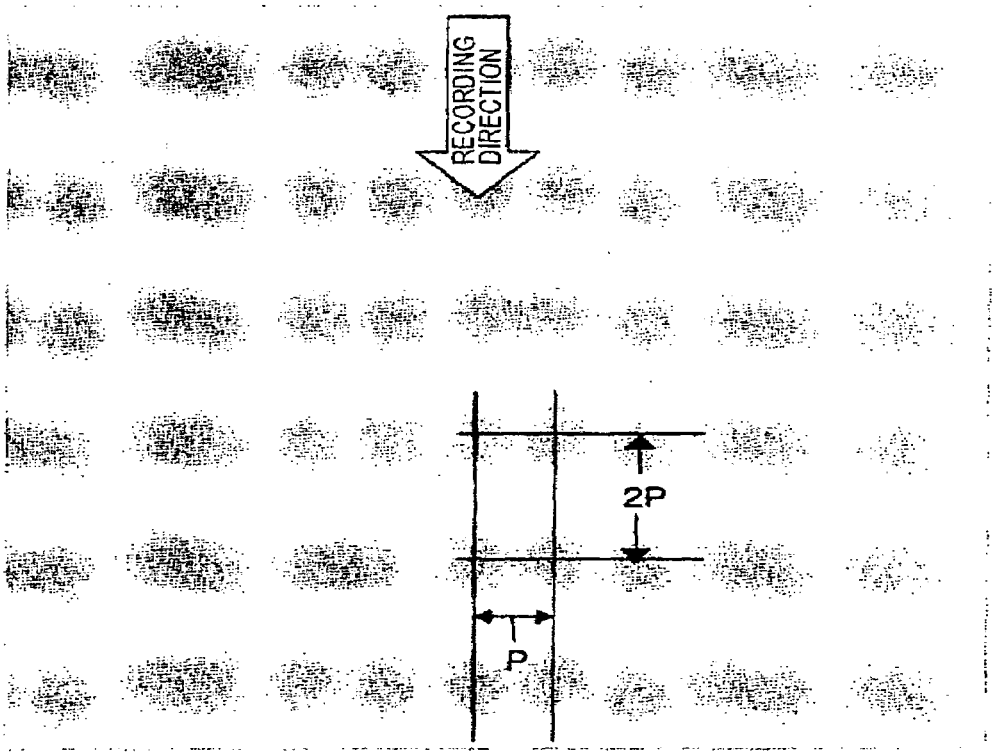
FIG. 15 shows in enlarged form a photograph of the arrangement of dots formed when the nozzle sheet is flexed as shown in FIG. 14.

In other words, there are slight differences in the angles of discharge of ink droplets from the nozzles 18, with these differences being characteristic of the nozzles 18. Therefore, when there is a nozzle 18 (liquid discharging unit) having a discharge characteristic that causes a dot formed thereby to contact a dot formed by an adjacent nozzle 18, dots formed by these adjacent nozzles 18 always overlap as viewed vertically. FIG. 15 is an enlarged view of an actual printing result, and shows that some adjacent dots overlap.

When wet dots immediately after they have landed on the recording medium contact each other, they do not merely theoretically undergo point contact, but the contact portion increases in width due to surface tension of the liquid, causing the dot shape to change. In order to improve image quality by mitigating this problem, if the nozzles 18 are arranged as in the embodiment, it is possible to dispose the dots as shown in FIG. 6B. Therefore, a margin is provided for the differences in the dot arrangements in the horizontal and vertical directions while the density is the same.

Figure 7B:
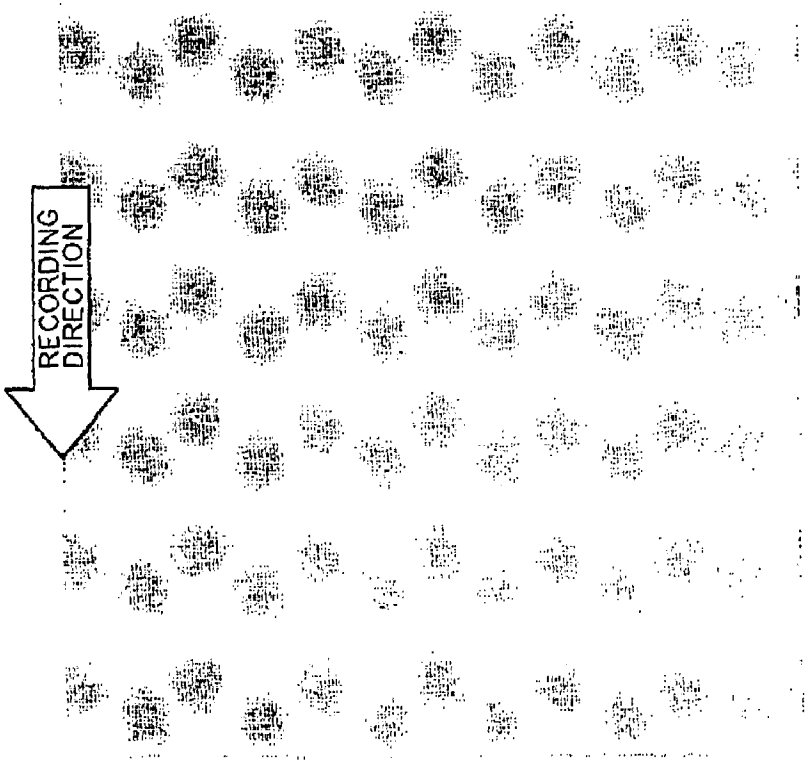
FIGS. 7A and 7B are enlarged views of photographs of actual printing results (dot arrangements) produced with the related head and the head of an embodiment.
Figure 7A:
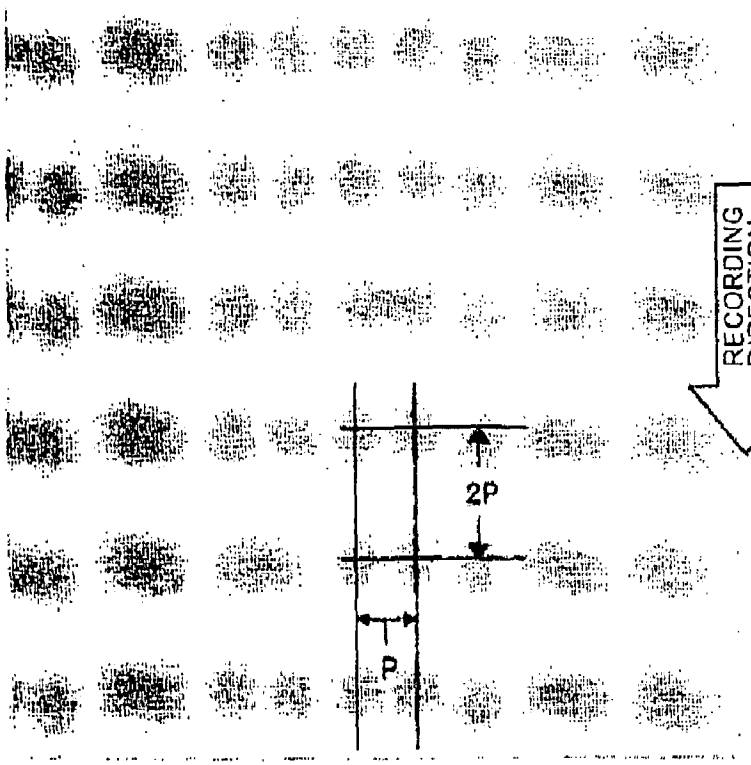

FIGS. 7A and 7B are enlarged views of photographs of actual printing results (dot arrangements).

FIG. 7A shows the result provided by the related head 1 of FIG. 11 (same as the result in FIG. 15), and FIG. 7B shows the result provided by the head 11 of FIG. 4 of the embodiment. In order to make the dot arrangements easier to see, the dots are alternately formed in the dimension in which the head and the recording medium move relative to each other.

FIG. 7B shows that in the embodiment adjacent dots substantially do not overlap, so that a horizontal margin is increased.

In the embodiment, since "division" of a dot non-formation area occurs, unevenness can be reduced.

FIG. 8 illustrates the division, concentrating on a dot non-formation area surrounded by four dots (two dots disposed in the horizontal direction and two dots disposed in the vertical direction).

Figure 8A:
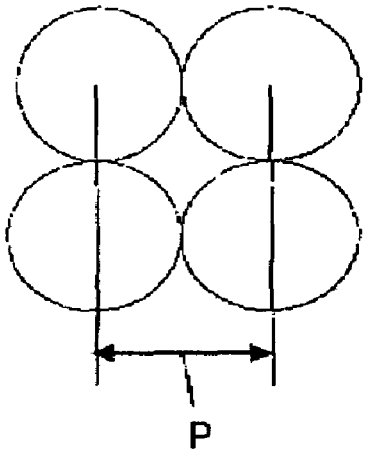
FIGS. 8A and 8B illustrate the division of a dot non-formation area.

As shown in FIG. 8A, when the related head 1 is used, four dots are arranged in a rectangular lattice, as a result of which a diamond-shaped area defined by arcs of the four dots is formed as a dot non-formation area. The length of a diagonal of the non-formation area is equal to the dot (nozzle pitch) P.

Figure 8B:
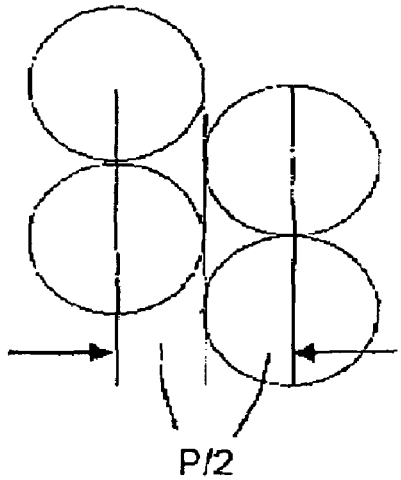

In contrast, when the head 11 of the embodiment is used, this diamond-shaped area is divided into two equal portions in the vertical direction, and these divided portions are displaced by P/2 in the vertical direction. Therefore, the lengths of the portions of the dot non-formation area in the horizontal direction are P/2 at most as shown in FIG. 8B.

Accordingly, in the embodiment, since the dot non-formation area portions having a small area that is half of that of the dot non-formation area that is formed when the dots are arranged in the rectangular lattice are displaced from each other, visually speaking, the dot non-formation area is divided, and, thus, are difficult to recognize (that is, spatial frequency is increased). Therefore, it is possible to increase image quality.

Next, the rigidity of each liquid discharging unit (portion including the nozzle sheet 17 and the barrier layer 16) in the embodiment will be described.

Figures 9A, 9B, 9C, 9D:
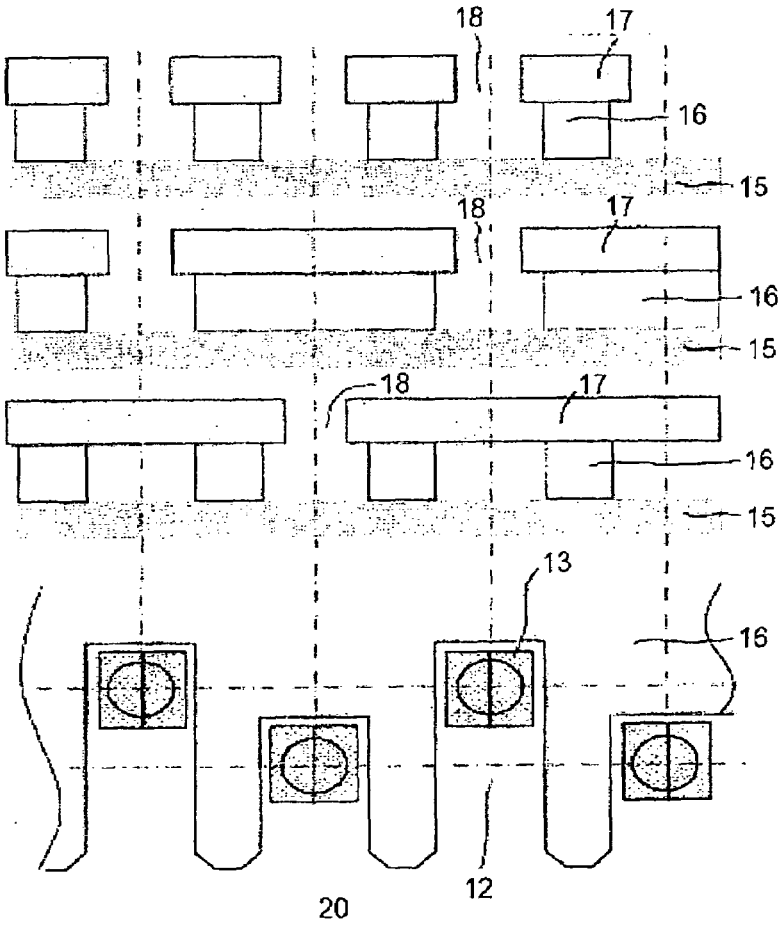
FIG. 9A is a sectional view of a structure shown in FIG. 11 along the center axial line of each nozzle at a line connecting the center of each nozzle.
FIG. 9B is a sectional view along the center axial line of each nozzle at the straight line L1 in FIG. 5.
FIG. 9C is a sectional view along the center axial line of each nozzle at the straight line L2.
FIG. 9D is a plan view showing as a reference the arrangement of the heating elements and the ink chambers corresponding to the nozzles.

FIGS. 9A to 9D are sectional views in the direction of arrangement of the liquid discharging units. FIG. 9A is a sectional view of the structure shown in FIG. 11 along the center axial line of each nozzle 18 at a line connecting the center of each nozzle 18. FIG. 9B is a sectional view along the center axial line of each nozzle 18 at the straight line L1 in FIG. 5. FIG. 9C is a sectional view along the center axial line of each nozzle 18 at the straight line L2. FIG. 9D is a plan view showing as a reference the arrangement of the heating elements 18 and ink chambers 12 corresponding to the nozzles 18.

In the structure shown in FIG. 9A, when a pressure change occurs as a result of discharging ink droplets, at the nozzle 18 central portions to which the largest stress is applied, the nozzle sheet 17 is only supported by portions of one barrier layer 16 between the nozzles 18. Therefore, it is unstably supported. As illustrated in FIGS. 2 and 3, the portions of the nozzle sheet 17 between the nozzles 18 move like a seesaw on the barrier layer 16 as a fulcrum. When the barrier layer 16 is formed separately from the nozzle sheet 17, and the nozzle sheet 17 is considerably more rigid than the barrier layer 16 (for example, the nozzle sheet 17 is formed by electroforming using nickel, and the barrier layer 16 is formed of rubber or acrylic resin), this may cause the barrier layer 16 to deform.

Comparing the row of nozzles 18 in FIG. 9B with that in FIG. 9A, the nozzles 18 are alternately disposed in FIG. 9B in relation to those shown in FIG. 9A. At the location where the nozzle 18 is not disposed in relation to FIG. 9A, the lower layer of the nozzle sheet 17 is reliably affixed (adhered) to the barrier layer 16. Therefore, the structure shown in FIG. 9B is the more rigid structure with respect to deformation.

Therefore, even if deformation occurs in the structure shown in FIG. 9B, the deformation amount is much smaller than that of the structure shown in FIG. 9A.

As in FIG. 9B, in the row of nozzles 18 shown in FIG. 9C, the nozzles 18 are alternately formed in relation to those shown in FIG. 9A, so that the structure shown in FIG. 9C is far less easily deformed than the structure shown in FIG. 9A. Cavities for the ink chambers 12 of the liquid discharging units adjacent to lower portions of the nozzle sheet 17 where the nozzles 18 are not formed are disposed below these lower portions of the nozzle sheet 17. However, this structure in FIG. 9C is more rigid with respect to deformation than the structure shown in FIG. 9A. Therefore, its rigidity is intermediate between the rigidities of the structures shown in FIGS. 9A and 9B.

Accordingly, in the embodiment, since the rigidities of the liquid discharging units can be increased, even if the nozzle sheet 17 is thin, the amounts of deformation of the nozzles 18 caused by pressure changes (internal change factor) resulting from the discharge of ink droplets are reduced, so that the amounts and directions of discharge of the ink droplets can be stabilized.

In, for example, cleaning the surface defining the nozzles 18, regarding the pressure (external change factor) applied to the surface defining the nozzles 18, since the surface area of the nozzle sheet 17 around the nozzles 18 is large, the deformation is further reduced, so that a stable contact pressure can be provided (that is, the cleaning effect can be increased).

Next, a different embodiment will be described.

Although, in the foregoing description, the liquid discharging units are disposed on one side of the common flow path 20 so as to face the same direction, they may be disposed on both sides of the common flow path 20.

Figure 10:
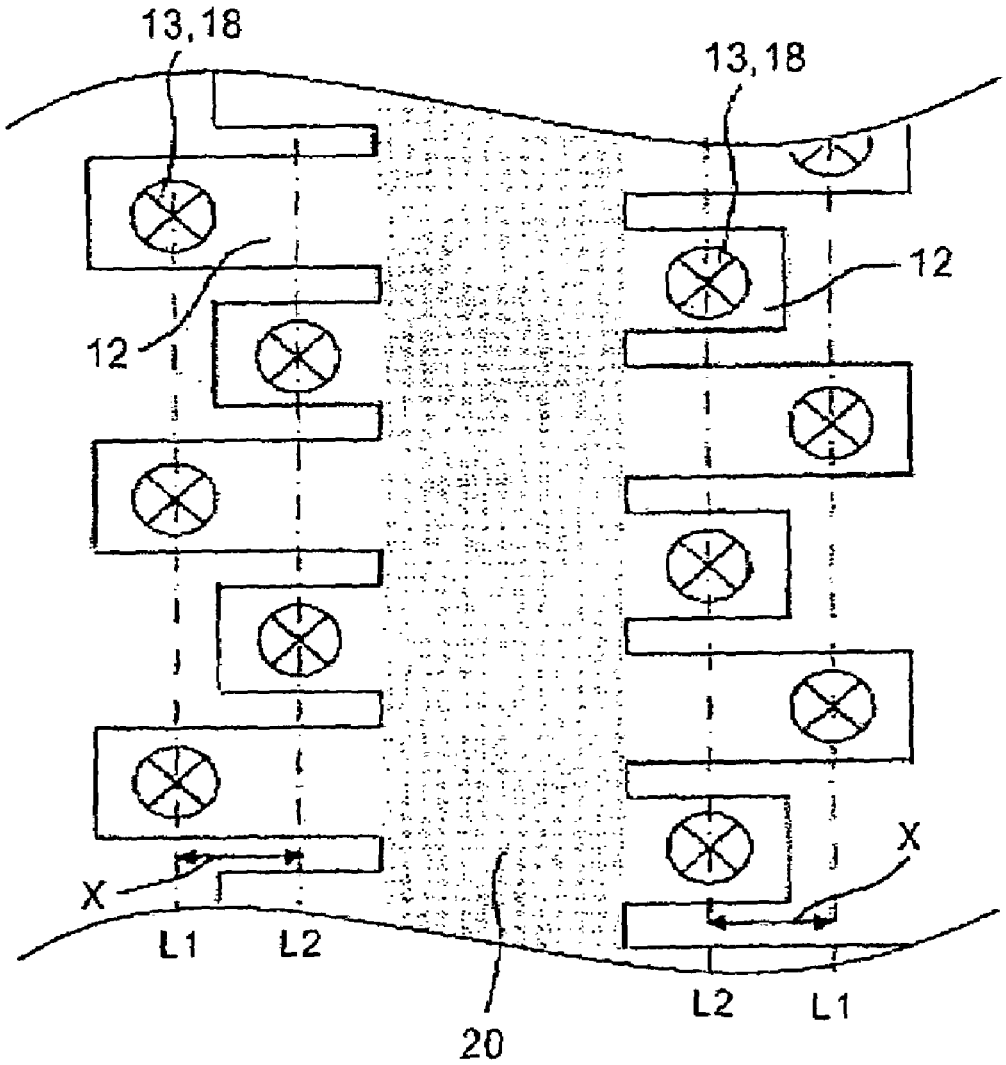
FIG. 10 is a plan view of an example of the arrangement of the nozzles (liquid discharging units) on both sides of one common flow path.

FIG. 10 is a plan view of an example of the arrangement of the nozzles 18 (liquid discharging units) on both sides of the common flow path 20. The nozzles 18 may be alternately disposed in the direction in which they are disposed at the interval X on the left and right sides of the common flow path 20 as shown in FIG. 10.

Although the embodiments of the present invention are described above, the present invention is not limited to these embodiments, so that various modifications may be made as follows.

(1) Although in the embodiments the heating elements 13 serve as thermal discharge power applying means, the discharge power applying means is not limited to the heating elements 13, so that other types of discharge power applying means may be used. For example, electrostatic discharge or piezo discharge power applying means may be used. The electrostatic discharge discharge power applying means comprises a diaphragm and two electrodes disposed below the diaphragm via an air layer. A voltage is applied between the electrodes in order to flex the diaphragm downward. Thereafter, the voltage is set at 0 V in order to release the electrostatic force. Here, ink droplets are discharged by making use of resilient force used to restore the diaphragm to its original state.

The piezo discharge power applying means has a layered structure of a piezo element having electrodes on both surfaces and a diaphragm. When a voltage is applied to both surfaces of the piezo element, a bending moment is produced at the diaphragm by the piezoelectric effect, causing the diaphragm to flex and deform. The deformation is made use of to discharge ink droplets.

(2) The number of air bubble generation areas of the heating elements 13 discharge force applying areas of the discharge power applying means) in one ink chamber 12 is not limited to one. Therefore, two air bubble generation areas may be disposed in the direction in which the nozzles 18 are disposed.

It is possible to provide main controlling means for discharging ink droplets along the central axial lines of the nozzles 18 so that a difference between the discharge forces at the two air bubble generation areas is not produced and subcontrolling means for performing a controlling operation so that the direction of discharge of ink droplets from the nozzles 18 differs from the direction of discharge of the ink droplets by the main controlling means by the difference between the discharge forces at the two air bubble generation areas (that is, the difference between the magnitudes of the discharge forces or the difference between the times for producing the discharge forces).

This technology makes it possible to provide high-quality printing by reducing variations in the landing positions of ink droplets as a result of varying the direction of discharge of ink droplets from the nozzles on the basis of, for example, the earlier filed and undisclosed technologies in Japanese Patent Application Nos. 2003-037343, 2002-360408, and 2003-55236. This technology is advantageous when the nozzle sheet 17 is thin as mentioned above. In this case, when the present invention is carried out, even if the nozzle sheet 17 is thin, it is possible to restrict flexing of areas around the nozzles 18 when ink droplets are discharged, so that stable and high-quality discharge of the ink droplets can be achieved. Therefore, by using this technology and the present invention in combination, the technology becomes more advantageous.

(3) Although in the embodiments the head 11 is described as being applied to a printer, the application of the head 11 used in the present invention is not limited to a printer. Therefore, it may be applied to various other types of liquid discharging devices. For example, it may be applied to a device for discharging a solution containing DNA for detecting biological material.

What is claimed is:

1. A liquid discharging head comprising:

a plurality of liquid discharging units including liquid chambers, discharge force applying means, and a nozzle member, the liquid chambers containing liquid to be discharged, the discharge force applying means being disposed proximate the liquid chambers for applying discharge force to the liquid in the liquid chambers, and the nozzle member having nozzles through which the liquid in the liquid chambers is discharged; and a common flow path for supplying the liquid to the liquid chambers of the liquid discharging units, wherein the liquid discharging units are disposed at a predetermined pitch P so that communication portions of the ink chambers with the common flow path face the same direction in relation to the common flow path, wherein the centers of the nozzles of adjacent liquid discharging units among the liquid discharging units are separated at an interval X in a direction perpendicular to a direction of arrangement of the liquid discharging units, where X is a real number greater than 0, and wherein the liquid discharging units are disposed so that the relationship between the pitch P and the interval X is: X=P/2.

2. A liquid discharging head comprising:

a plurality of liquid discharging units including liquid chambers, discharge force applying means, and a nozzle member, the liquid chambers containing liquid to be discharged, the discharge force applying means being disposed proximate the liquid chambers for applying discharge force to the liquid in the liquid chambers, and the nozzle member having nozzles through which the liquid in the liquid chambers is discharged; and a common flow path for supplying the liquid to the liquid chambers of the liquid discharging units, wherein the liquid discharging units are disposed at a predetermined pitch P so that communication portions of the ink chambers with the common flow path face the same direction in relation to the common flow path, and wherein the centers of the nozzles of Mth liquid discharging units from one end among the liquid discharging units are disposed on a first straight line extending along the common flow path, and the centers of the nozzles of Nth liquid discharging units from said one end among the liquid discharging units are disposed on a second straight line; wherein N is an even number when M is an odd number, and N is an odd number when M is an even number; and wherein the second straight line being parallel to the first straight line and being separated from the first straight line by a predetermined interval X, where X is a real number greater than 0 and wherein the liquid discharging units are disposed so that the relationship between the pitch P and the interval X is: X=P/2.

3. A liquid discharging device comprising:

a liquid discharging head comprising a plurality of liquid discharging units and a common flow path, the liquid discharging units including liquid chambers, discharge force applying means, and a nozzle member, the liquid chambers containing liquid to be discharged, the discharge force applying means being disposed proximate the liquid chambers for applying discharge force to the liquid in the liquid chambers, and the nozzle member having nozzles through which the liquid in the liquid chambers is discharged, the common flow path supplying the liquid to the liquid chambers of the liquid discharging units, wherein the liquid discharging units are disposed at a predetermined pitch P so that communication portions of the ink chambers with the common flow path face the same direction in relation to the common flow path, and wherein the centers of the nozzles of Mth liquid discharging units from one end among the liquid discharging units are disposed on a first straight line extending along the common flow path, and the centers of the nozzles of Nth liquid discharging units from said one end among the liquid discharging units are disposed on a second straight line, wherein N is an even number when M is an odd number, and N is an odd number when M is an even number, the second straight line being parallel to the first straight line and being separated from the first straight line by a predetermined interval X, where X is a real number greater than 0, and wherein the liquid discharging units are disposed so that the relationship between the pitch P and the interval X is: X=P/2.

* * * * *